US010330110B2

(12) United States Patent
Bajeet et al.

(10) Patent No.: US 10,330,110 B2
(45) Date of Patent: Jun. 25, 2019

(54) PUMP IMPELLER

(75) Inventors: Jean-Noel Bajeet, Wexford (IE); Ian Cullen, Wexford (IE)

(73) Assignee: Sulzer Management AG, Winterthur (CH)

( * ) Notice: Subject to any disclaimer, the term of this patent is extended or adjusted under 35 U.S.C. 154(b) by 1005 days.

(21) Appl. No.: 13/500,053

(22) PCT Filed: Oct. 7, 2010

(86) PCT No.: PCT/EP2010/065045
§ 371 (c)(1),
(2), (4) Date: Jun. 27, 2012

(87) PCT Pub. No.: WO2011/042515
PCT Pub. Date: Apr. 14, 2011

(65) Prior Publication Data

US 2012/0282085 A1 Nov. 8, 2012

(30) Foreign Application Priority Data

Oct. 8, 2009 (SE) ..... 0901289

(51) Int. Cl.
*F04D 29/22* (2006.01)

(52) U.S. Cl.
CPC ..... *F04D 29/225* (2013.01); *F04D 29/2288* (2013.01)

(58) Field of Classification Search
CPC ..... F04D 7/04; F04D 7/045; F04D 29/183; F04D 29/242; F04D 29/2216; F04D 29/2288; F04D 29/225
USPC ..... 415/71, 75, 121.1, 121.2; 416/176, 179, 416/182, 185
See application file for complete search history.

(56) References Cited

U.S. PATENT DOCUMENTS 1,754,992 A * 4/1930 Fabrin ..... F04D 29/225
415/198.1
3,130,678 A 4/1964 Chenault
3,776,659 A * 12/1973 Coon, Jr. ..... F04D 9/02
415/147
4,427,336 A * 1/1984 Lake ..... 415/71
4,556,364 A * 12/1985 Barker ..... F04D 29/2294
415/172.1
4,575,312 A * 3/1986 Erikson ..... F04D 29/225
415/206

(Continued)

FOREIGN PATENT DOCUMENTS

CH 418 833 A 8/1966
DE 37 04 360 A1 8/1988

OTHER PUBLICATIONS

The International Search Report/Written Opinion of the International Searching Authority in corresponding PCT application, dated Feb. 17, 2011.

*Primary Examiner* — Kayla McCaffrey
(74) *Attorney, Agent, or Firm* — Kilpatrick Townsend & Stockton LLP

(57) ABSTRACT

The present invention provides a pump impeller which has improved anti clogging characteristics, in particular through the use of an impeller vane having a specially profiled leading edge which, during operation of the impeller, forces rags or the like down along the leading edge, which increases in thickness along the length thereof, until the rags become re-entrained in the fluid and thus exit the impeller avoiding the clogging thereof.

16 Claims, 5 Drawing Sheets

(56) References Cited

U.S. PATENT DOCUMENTS

| | | | | | |
|---|---|---|---|---|---|
| 4,842,479 | A * | 6/1989 | Dorsch | F04D 7/045 | 415/121.1 |
| 5,478,200 | A * | 12/1995 | Brodersen | F04D 29/242 | 415/206 |
| 5,542,817 | A * | 8/1996 | Brandt | 415/58.2 | |
| 6,390,768 | B1 * | 5/2002 | Muhs et al. | 415/71 | |
| 7,114,925 | B2 * | 10/2006 | Shaw | 416/185 | |
| 2009/0232639 | A1 * | 9/2009 | Arnold | F04D 29/167 | 415/121.1 |

* cited by examiner

PUMP IMPELLER

CROSS-REFERENCE TO RELATED APPLICATION

This application is a National Stage of International Application No. PCT/EP2010/065045 filed Oct. 7, 2010, and which claims the benefit of Swedish Patent Application No. 0901289-9 filed Oct. 8, 2009, the disclosures of which are incorporated herein by reference.

FIELD OF THE INVENTION

This invention relates to a pump impeller, and in particular to a pump impeller whose design significantly reduces clogging of the impeller by rags or other fibrous material entrained in the fluid being pumped, and which impeller is adapted to actively clear such contaminants from the impeller.

BACKGROUND OF THE INVENTION

Impellers are used in many different applications, one of the most demanding of which is in submersible pumps used for pumping sewage or other liquids having a solid content comprising rags or other material contaminants. These rags have a tendency to wrap themselves around the impeller, degrading the performance and ultimately clogging the pump. The pump must then be shut down and retrieved for repair, resulting in significant down time. The main clogging issue results from the rags becoming wrapped around or doubled over on the leading edge of the impeller vane, which both reduces the pumping performance of the vane, and leads to increased rag retention by the impeller.

There are also other clogging issues when using impellers for pumping liquids having rag or other solid content. For example the interior volume defined by the impeller vane may develop areas of low fluid circulation or even stagnation, within which pockets solids may gather, posing a further risk of clogging.

It is therefore an object of the present invention to provided a pump impeller which reduces or eliminates the above problems.

SUMMARY OF THE INVENTION

According to a first aspect of the present invention there is provided a pump impeller for use in combination with a wear plate, the impeller comprising a single impeller vane defining an interior space through which fluid is displaced, the impeller vane having a leading edge, a trailing edge and an upper rim for location, in use, adjacent the wear plate; and a shroud from which the vane projects; wherein the leading edge is profiled to actively displace solid material entering the impeller in a direction away from the wear plate.

In an embodiment of the invention the leading edge is substantially concave in profile.

In an embodiment of the invention the leading edge defines a tip at the upper rim and a root at the shroud, the leading edge curving inwardly from both the tip and the root.

In an embodiment of the invention the leading edge defines an acute angle with both the shroud and the upper rim.

In an embodiment of the invention the leading edge increases in thickness from the tip to the root.

In an embodiment of the invention the impeller vane comprises a sloping inner wall.

In an embodiment of the invention at least a portion of the inner wall slopes radially outward from the shroud towards the upper rim.

In an embodiment of the invention at least a portion of the inner wall slopes axially upward from the shroud towards the upper rim.

In an embodiment of the invention the pump impeller comprises a relief hole extending through the impeller vane from an underside thereof to the interior space defined by the impeller vane.

In an embodiment of the invention the relief hole is positioned to issue, in use, a jet of fluid into the interior space defined by the impeller such as to improve circulation within the interior space.

In an embodiment of the invention the pump impeller comprises a cavity formed in the impeller in order to achieve dynamic balance during use.

In an embodiment of the invention the relief hole extends from the cavity, through the impeller vane, to the interior space.

In an embodiment of the invention the pump impeller comprises an annular wavy profile on an underside of the shroud.

In an embodiment of the invention the trailing edge overhangs the shroud.

In an embodiment of the invention the trailing edge is tapered.

According to a second aspect of the invention there is provided a pump comprising an impeller according to the first aspect of the invention.

DETAILED DESCRIPTION OF THE DRAWINGS

Figure 1:
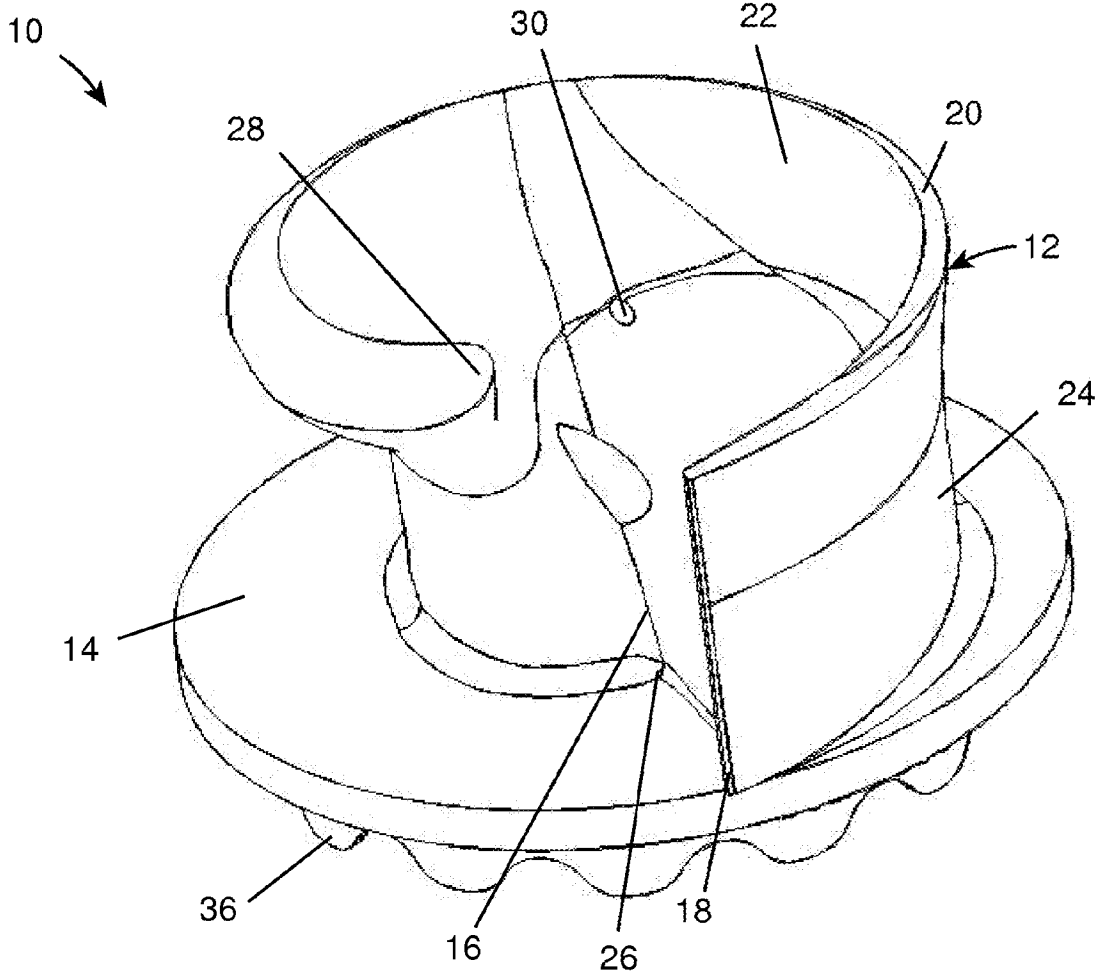
FIG. 1 illustrates a perspective view of a pump impeller according to an embodiment of the present invention.

Referring now to the accompanying drawings there is illustrated a pump impeller, generally indicated as 10, for use within a submersible pump (not shown) or the like and for pumping liquids, in particular liquids having a solid content such as rags or other material which is known to cause clogging of pumps.

The impeller 10 comprises an impeller vane 12 which projects upwardly from, and is preferably formed integrally with a circular shroud 14. In the embodiment illustrates the entire impeller 10 is cast of metal, for example cast iron, although any other suitable material may be employed. The vane 12 comprises a leading edge 16 and a trailing edge 18 located radially outwardly from the leading edge 16. The trailing edge 18 preferably overhangs the shroud 14, the reasons for which are set out hereinafter.

The vane 12 further comprises an upper rim 20 which, in use, is located in close proximity to a wear plate 37 forming part of the pump, which arrangement is well known in the art of impeller based pumps. The wear plate 37 will normally have a central opening therein which forms the inlet through which fluid is drawn into the impeller 10, and which is then discharged from the impeller 10 through the channel defined between the leading edge 16 and the trailing edge 18. The wear plate 37 essentially forms a cover about the upper rim 20, such that in use the vane 12 is encapsulated between the wear plate and the shroud 14, thereby allowing the vane 12 to build up a pressure head in order to be capable of pumping liquids. For this reason the gap between the wear plate 37 and the upper rim 20 should be kept to a minimum. This does however present problems during operation, one of which is the issue of rags or other solids becoming trapped or lodged between the wear plate 37 and the upper rim 20.

Figure 2:
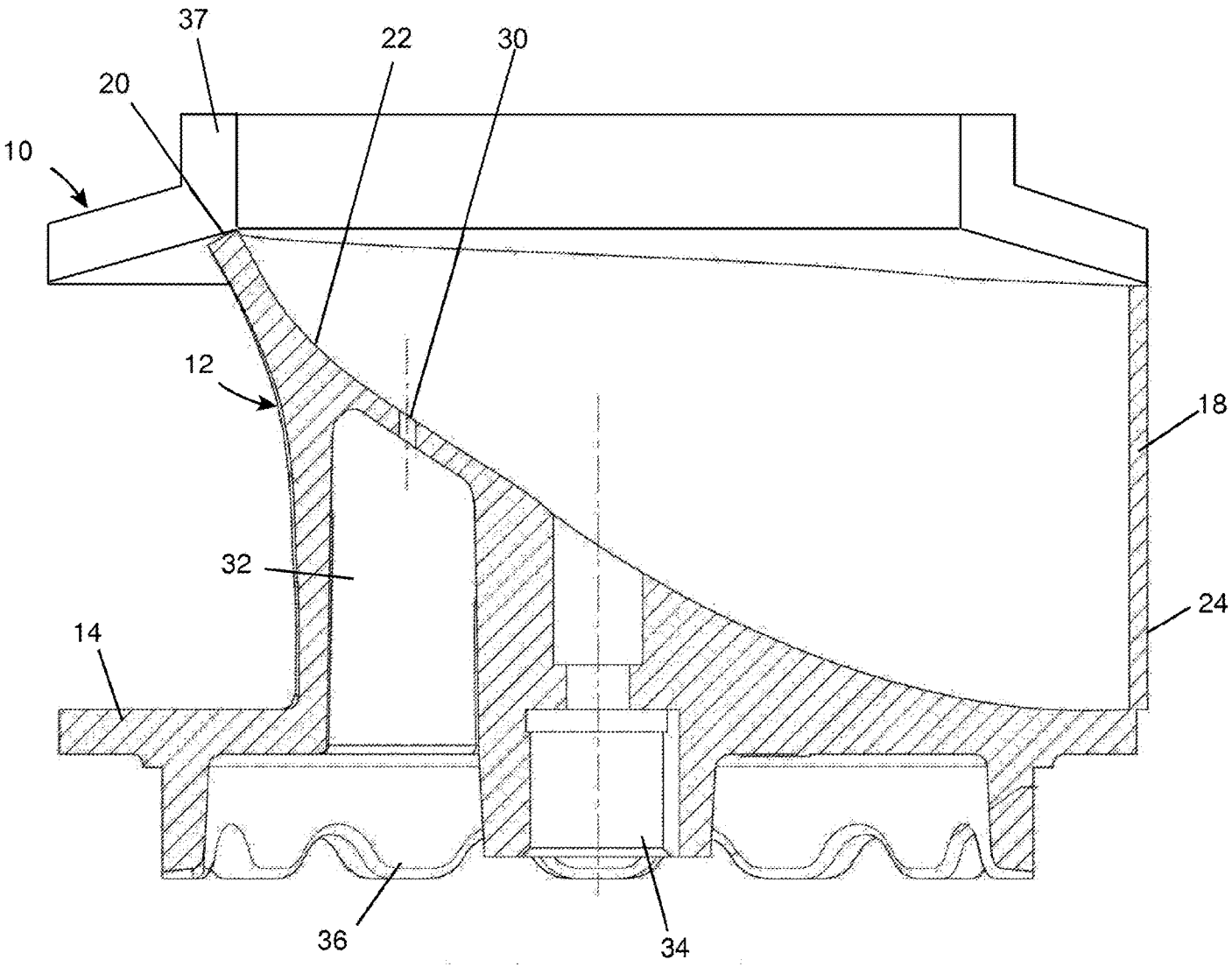
FIG. 2 illustrates a sectioned elevation of the impeller shown in FIG. 1.

The impeller vane 12 includes an inner wall 22 and an outer wall 24, the inner wall 22 having a sloping profile such as to define a path through the impeller 10 which extends helically downward from the upper rim 20 to the shroud 14. Referring in particular to FIG. 2 it can be seen that providing this helical path through the impeller 10 from the inlet to the outlet requires significant portions of infill directly above the shroud 14. This eliminates dead space within the impeller 10 which can give rise to clogging, in particular where solids such as rags or the like are being pumped with the fluid, for example in the case of sewage. This is achieved by sloping the inner wall 22 radially inwardly from the upper rim 20, in particular in the region adjacent the leading edge 16, with the slope of the inner wall 22 reducing towards the trailing edge 18, such that the inner wall 22 in the region of the trailing edge 18 is substantially vertical. Thus the thickness of the vane 12 increases in the axial direction from the upper rim 20 downward towards the shroud 14, and again this increase in thickness is more pronounced in the region of the leading edge 16. In this way, as the leading edge extends down from the upper rim 20 to the shroud 14 it opens out into the flow of fluid through the impeller 10.

Figure 3:
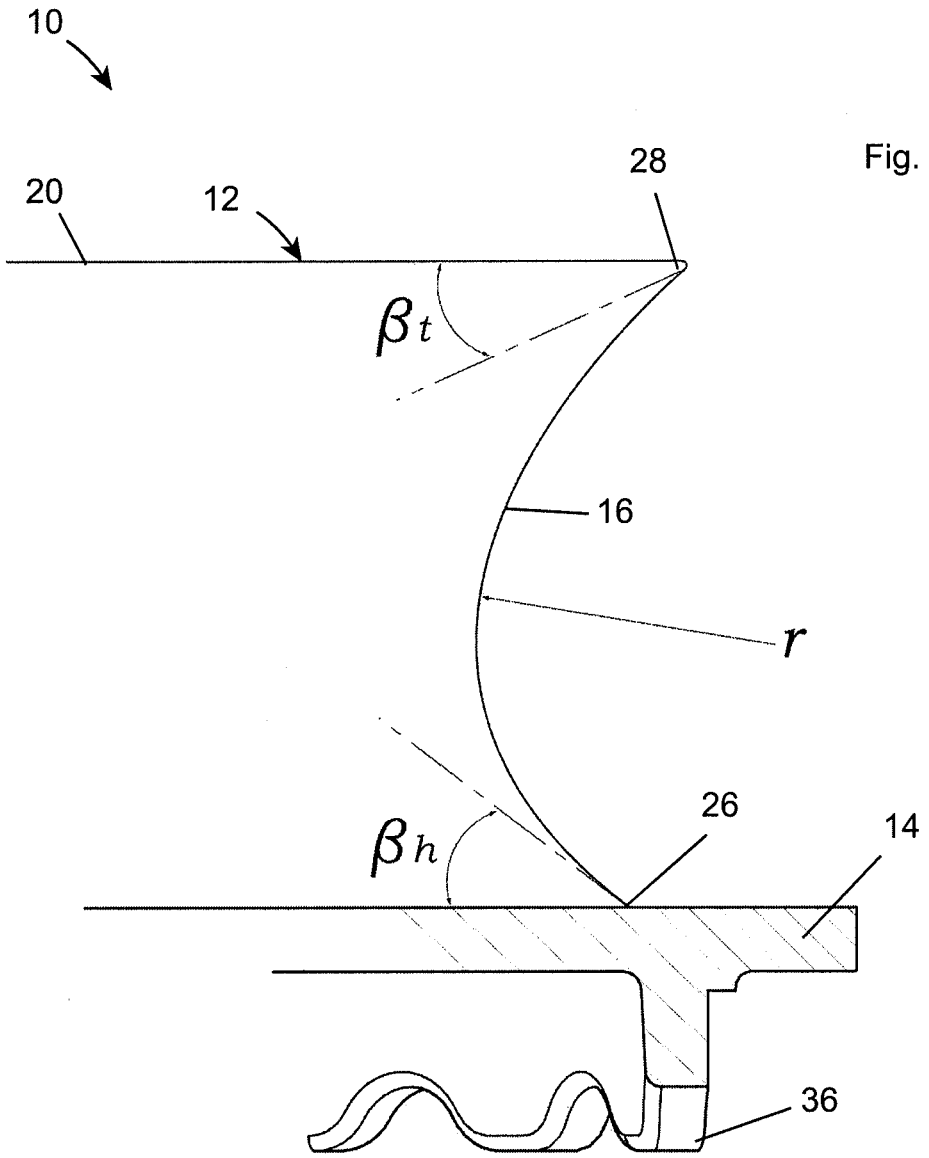
FIG. 3 illustrates a sectioned view of a leading edge of an impeller vane forming part of the impeller of FIGS. 1 and 2.
Figure 4:
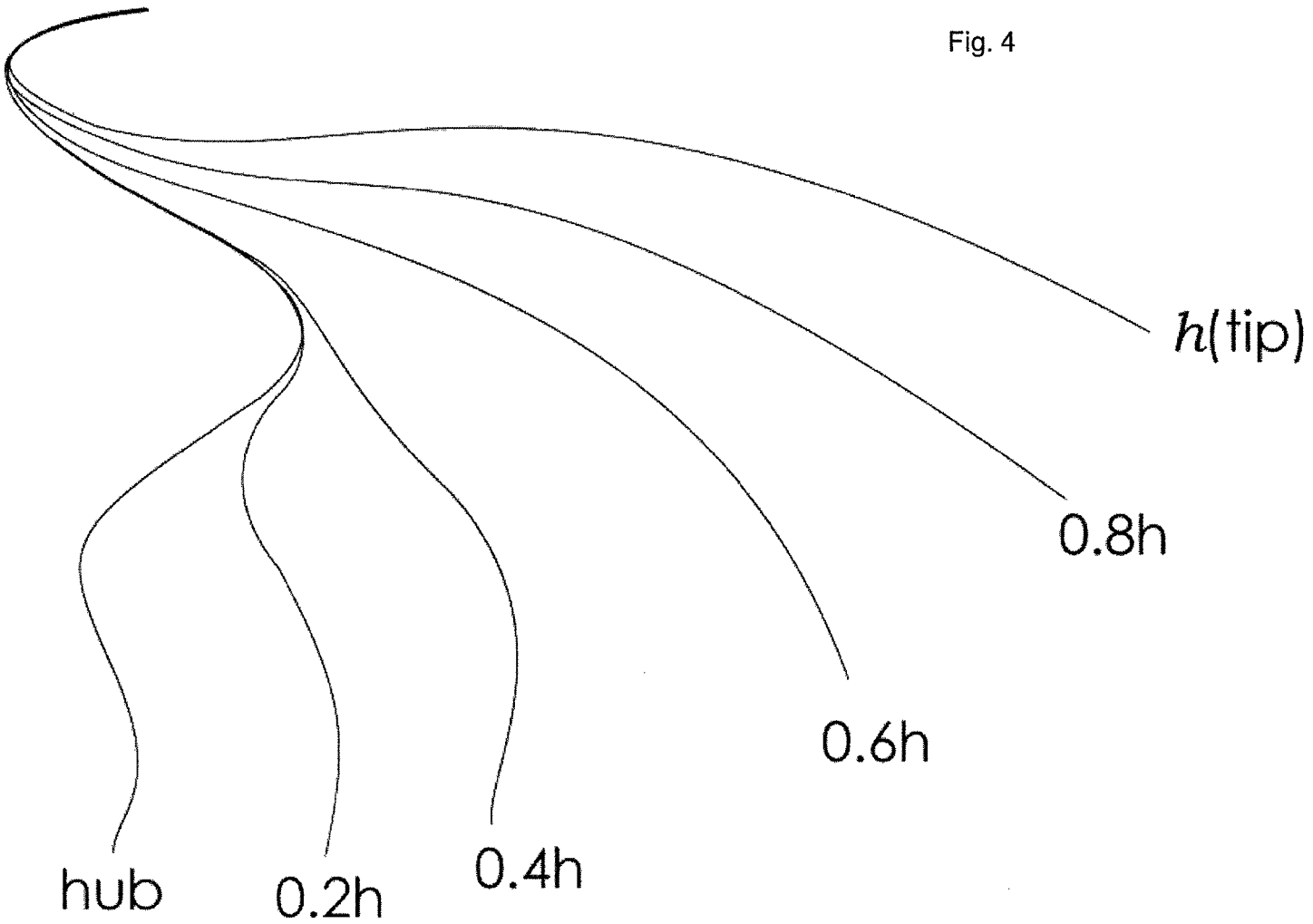
FIG. 4 illustrates the radial profile of the leading edge of the impeller vane, at various heights through the impeller.

Referring now in particular to FIGS. 3 and 4, it can be seen that the leading edge 16, in particular when viewed in profile, is substantially concave in shape. The leading edge 16 extends rearwardly into the vane 12 from a root 26 at the shroud 14, before curving back outwardly towards a tip 28 at the upper rim 20. Thus the leading edge 16 can be said to curve inwardly, with respect to the vane 12, at both the root 26 and at the tip 28. Referring to FIG. 3 it can be seen that this results in the leading edge 16 defining an acute angle $\beta_h$ with the upper surface of the shroud 14 at the root 26 and an acute angle $\beta_t$ with the upper rim 20 at the tip 28. The leading edge 16 preferably has a smooth radius of curvature r between the root 26 and the tip 28, in order to prevent snagging of rags or other solids.

This concave profiling of the leading edge 16 has the effect, in use, of causing any rags or other solids which wrap themselves around the leading edge 16 to be forced downwardly away from the upper rim 20 and associated wear plate 37 between which such rags may otherwise become trapped, eventually leading to clogging of the impeller 10. As the rags move down along the trailing edge 18 towards the shroud 14 they are moving in to an area of a greater radial flow of fluid out of the impeller 10, and thus become re-entrained in the fluid flow and leave the leading edge 16 free of clogging. In addition, as the leading edge increases in thickness from the tip 28 to the root 26, as a rag is drawn along the leading edge 16 towards the root 26 it will be opened out to become less doubled over around the leading edge 16. This will reduce the adherence of the rag to the leading edge 16, allowing it to peel off the leading edge 16 and exit the impeller 10 in the flow of fluid. This increase in thickness can be clearly seen from FIG. 4, showing the radial profile of the leading edge 16 at various heights through the impeller 10.

The use of the profiled leading edge 16 not only ensures that rags or other solids do not accumulate on the leading edge 16, which would reduce the performance of the impeller 10, but also ensure that such rags do not become trapped between the upper rim 20 and the wear plate 37, which increases friction between the impeller 10 and the ware plate, thus reducing the performance of the associated pump (not shown), and also increase wear on the wear plate, leading to greater losses in the pump. The profile of the leading edge 16 ensures that rags which initially enter the impeller 10 and adhere to the leading edge 16 are immediately pushed down along the leading edge 16 in order to prevent such rags from lodging between the upper rim 20 and the wear plate 37. Then as the thickness of the leading edge 16 increases from the tip 28 to the root 26 the rags will be released from around the leading edge 16.

In order to further improve the anti-clogging functionality of the impeller 10, a relief hole 30 is provided in the impeller vane 12, and extends from a balancing cavity 32 which is open to the underside of the impeller 10, through to the interior space defined within the vane 12. The balancing cavity 32 is provided in order to reduce the mass of the impeller 10 on the heavier side thereof, in order to achieve dynamic balance of the impeller 10 during use. This is necessary due to the significant infill used to achieve the sloping helical path through the impeller 10.

In use, the underside of the impeller 10, in which the balancing cavity 32 is formed, is at a greater pressure than the interior space defined within the vane 12. This pressure differential results, in use, in a jet of fluid issuing from the relief hole 30 into the space defined within vane 12. This jet of fluid helps to increase the circulation of fluid within the vane 12 in order to further reduce the possibility of clogging. The relief hole 32 may be positioned and/or dimensioned such as to direct the jet of fluid towards a particular region of the space defined by the vane 12 in order to target areas in which clogging is more likely to occur.

The relief hole 30 also facilitates a reduction in the pressure difference between the high and low pressure sides of the impeller 10, thus reducing pressure and therefore wear on the bearings etc, and so increasing the performance and/or longevity of the pump (not shown) of which the impeller 10 is a part. On this point it can be seen from FIG. 2 that the impeller 10 comprises a central bore 34 into which, in use, the main shaft of the pump (not shown) is located and terminates, allowing the impeller 10 to be bolted thereto. The shroud 14 is also provided an annular wavy profile 36 of known form, which protect the mechanical seals within the pump during operation.

Figure 5:
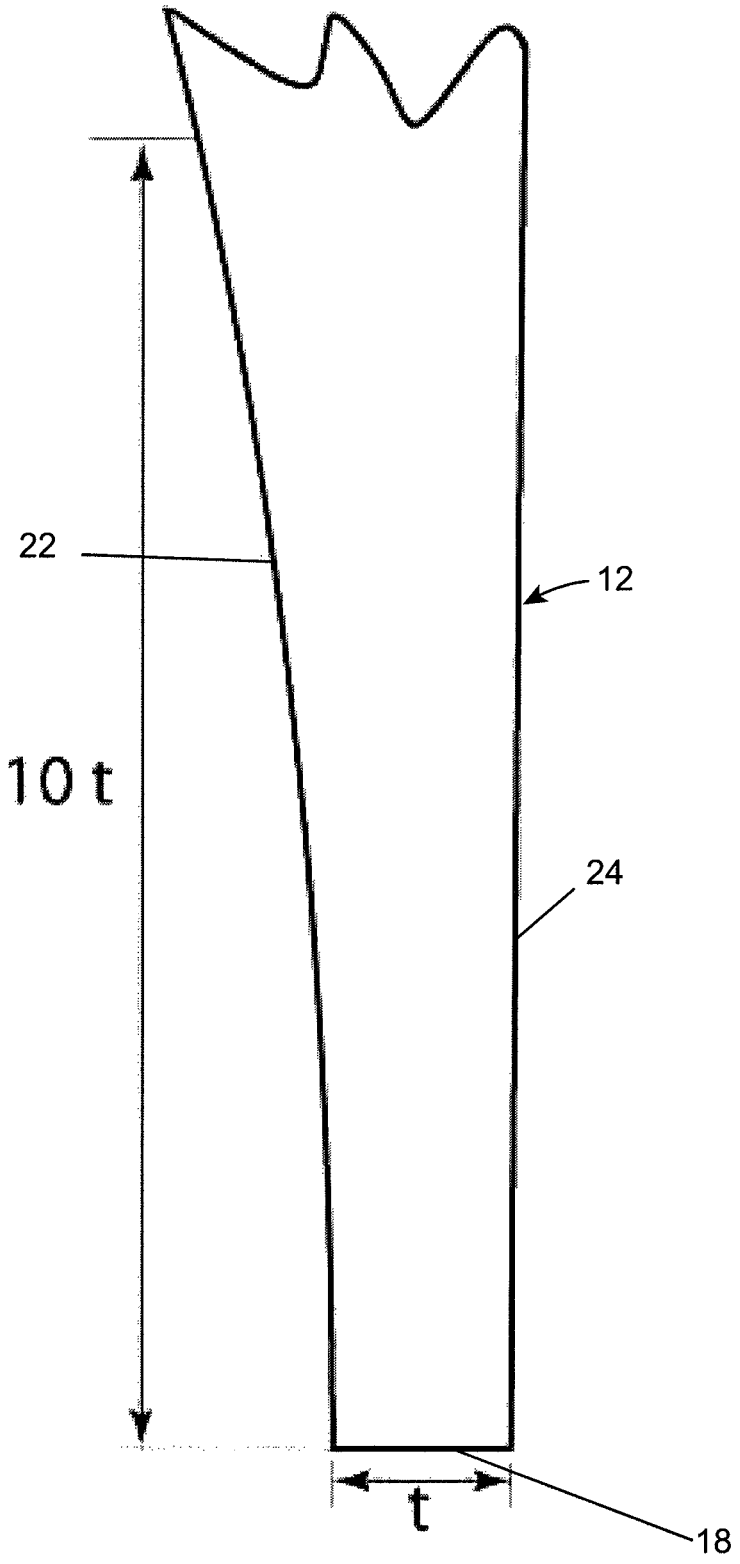
FIG. 5 illustrates an enlarged view of the trailing edge of the impeller vane.

Finally, referring to FIG. 5, the trailing edge 18 is shown in detail. As mentioned above, it is preferable that the trailing edge 18 overhangs the shroud 14, which allows the shroud 14 to be relatively smaller in diameter for a given diameter of vane 12. As a result of the smaller diameter of the shroud 14, the impeller 10 will have lower power consumption for a given pumping capacity. The trailing edge 18 is also preferably tapered in order to reduce turbulence and losses.

The impeller 10 of the present invention therefore provides improved anti-clogging performance through the use of a specially profiled leading edge 16, in addition to the relief hole 30, which together actively reduce clogging when pumping fluids having a solid content, in particular in the form of rags.

The invention claimed is:

1. A pump impeller for use in combination with a wear plate, the pump impeller comprising:

a single impeller vane defining an interior space through which fluid is displaced, the impeller vane having a leading edge, a trailing edge and an upper rim for location, in use, adjacent the wear plate, wherein the impeller vane comprises a sloping inner wall that crosses a central bore for receiving a main shaft of a pump; and a shroud from which the impeller vane projects;

wherein the leading edge is profiled to actively displace solid material entering the impeller in a direction away from the wear plate, wherein the leading edge defines a tip at the upper rim and a root at the shroud, the leading edge extending rearward into the impeller vane from the root and curving outward toward the tip such that the leading edge forms a first acute angle with an upper surface of the shroud at the root and a second acute angle with the upper rim at the tip.

2. The pump impeller according to claim 1 in which the leading edge is substantially concave in profile.

3. The pump impeller according to claim 1 in which the leading edge increases in thickness from the tip to the root.

4. The pump impeller according to claim 1 in which at least a portion of the inner wall slopes radially outward from the shroud towards the upper rim.

5. The pump impeller according to claim 4 in which slope of the inner wall reduces toward the trailing edge, and a portion the inner wall adjacent to the trailing edge is substantially vertical.

6. The pump impeller according to claim 1 in which at least a portion of the inner wall slopes axially upward from the shroud towards the upper rim.

7. The pump impeller according to claim 1 comprising a relief hole extending through the impeller vane from an underside thereof to the interior space defined by the impeller vane.

8. The pump impeller according to claim 7 in which the relief hole is positioned to issue, in use, a jet of fluid into the interior space defined by the impeller such as to improve circulation within the interior space.

9. The pump impeller according to claim 1 comprising a cavity formed in the impeller in order to achieve dynamic balance during use.

10. The pump impeller according to claim 9 comprising a relief hole extending through the impeller vane from an underside thereof to the interior space defined by the impeller vane, in which the relief hole extends from the cavity, through the impeller vane, to the interior space.

11. The pump impeller according to claim 1 comprising an annular wavy profile on an underside of the shroud.

12. The pump impeller according to claim 1 in which the trailing edge overhangs the shroud.

13. The pump impeller according to claim 1 in which the trailing edge is tapered.

14. A pump comprising an impeller according to claim 1.

15. The pump impeller according to claim 1 in which a gap is provided between the wear plate and the upper rim.

16. The pump impeller according to claim 1 in which a thickness of the impeller vane increases in an axial direction from the upper rim downward towards the shroud.

* * * * *